US011745528B2

(12) United States Patent
Walley et al.

(10) Patent No.: US 11,745,528 B2
(45) Date of Patent: Sep. 5, 2023

(54) TAPE DRIVE

(71) Applicant: VIDEOJET TECHNOLOGIES INC., Wood Dale, IL (US)

(72) Inventors: Gareth Walley, Nottingham (GB); Martin McNestry, Derbyshire (GB); Gary Pfeffer, Nottingham (GB); Philip Hart, Nottingham (GB)

( * ) Notice: Subject to any disclaimer, the term of this patent is extended or adjusted under 35 U.S.C. 154(b) by 125 days.

(21) Appl. No.: 16/624,594

(22) PCT Filed: Jun. 29, 2018

(86) PCT No.: PCT/GB2018/051837

§ 371 (c)(1),
(2) Date: Dec. 19, 2019

(87) PCT Pub. No.: WO2019/002886

PCT Pub. Date: Jan. 3, 2019

(65) Prior Publication Data

US 2020/0114671 A1 Apr. 16, 2020

(30) Foreign Application Priority Data

Jun. 29, 2017 (GB) ..... 1710391

(51) Int. Cl.
*B41J 33/34* (2006.01)
*B41J 2/325* (2006.01)
(Continued)

(52) U.S. Cl.
CPC ..... *B41J 33/34* (2013.01); *B41J 2/325* (2013.01); *B41J 33/16* (2013.01); *B41J 29/38* (2013.01); *B41J 35/36* (2013.01)

(58) Field of Classification Search
None
See application file for complete search history.

(56) References Cited

U.S. PATENT DOCUMENTS 3,980,890 A * 9/1976 Heckrodt ..... B07C 5/34 250/559.28
4,115,013 A * 9/1978 Hedstrom ..... B41J 35/36 400/208
(Continued)

FOREIGN PATENT DOCUMENTS

CN 106382892 A 2/2017
JP H10244724 A 9/1998
(Continued)

OTHER PUBLICATIONS

PCT/GB2018/051837 International Search Report and Written Opinion, dated Nov. 2, 2018, 14 pages.
Search Report for GB1710391.2, dated Feb. 5, 2018, 4 pages.

*Primary Examiner* — Jill E Culler
(74) *Attorney, Agent, or Firm* — Wolter Van Dyke Davis, PLLC; Robert L. Wolter

(57) ABSTRACT

There is provided a tape drive. The tape drive comprises first and second spool supports on which spools of tape may be mounted. The tape drive further comprises an optical sensing system. The optical sensing system comprises a radiation emitter and a radiation detector, said radiation emitter and radiation detector having a fixed positional relationship in use with respect to said first and second spool supports. The tape drive further comprises a controller. The controller is operative to, energise the radiation emitter to emit radiation, and determine a diameter data indicative of a diameter of a spool mounted on one of the first and second spool supports based on a radiation signal generated by the detector.

21 Claims, 9 Drawing Sheets

(51) Int. Cl.

| | |
|---|---|
| ***B41J 33/16*** | (2006.01) |
| *B41J 29/38* | (2006.01) |
| *B41J 35/36* | (2006.01) |

(56) References Cited

U.S. PATENT DOCUMENTS

| | | | | |
|---|---|---|---|---|
| 4,555,633 | A | 11/1985 | Bjorkelund | |
| 4,636,097 | A * | 1/1987 | Goubeaux | B41J 31/16 400/196.1 |
| 5,110,229 | A * | 5/1992 | Ide | B41J 35/36 400/219 |
| 5,820,280 | A | 10/1998 | Fox | |
| 6,989,180 | B2 * | 1/2006 | Keeton | B41J 35/36 428/32.6 |
| 7,150,572 | B2 | 12/2006 | McNestry et al. | |
| 2013/0286306 | A1 * | 10/2013 | Eiyama | B41J 29/46 349/19 |

FOREIGN PATENT DOCUMENTS

| | | | |
|---|---|---|---|
| JP | 2014128947 | A | 7/2014 |
| JP | 2015063077 | A | 4/2015 |
| WO | 2003029013 | A1 | 4/2003 |
| WO | 2005106388 | A1 | 11/2005 |

* cited by examiner

TAPE DRIVE

The present invention relates to a tape drive, and more particularly, but not exclusively, to a tape drive suitable for use in a transfer printer such as a thermal transfer printer.

Tape drives find a wide variety of uses. One such example is in thermal transfer printers—in which ink is transferred from an ink carrying tape, often referred to as a ribbon—which require a means for transporting the ribbon from a supply spool to a take-up spool past a print head. A tape drive typically comprises two tape spool supports on which spools of tape, such as ink ribbon, may be mounted, and may also include one or more motors for rotating one or both of the spool supports and a controller for operating the motors. In a printing operation, ink carried on the ribbon is transferred to a substrate which is to be printed. To effect the transfer of ink, a print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

Some tape drives require that the diameter of one or both of the spools is determined in order to allow the spools to be rotated in a controlled manner to cause predetermined movement of the tape between the spools. For example it is known to use an optical system to determine spool diameters. Such a system is described in U.S. Pat. No. 7,150,572.

It is an object of some embodiments of the present invention to provide a tape drive which allows the diameters of one or both of the tape spools to be determined.

In a first aspect of the invention, there is provided a tape drive. The tape drive comprises first and second spool supports on which spools of tape may be mounted. The tape drive further comprises an optical sensing system. The optical sensing system comprises a radiation emitter and a radiation detector, said radiation emitter and radiation detector having a fixed positional relationship in use with respect to said first and second spool supports. The tape drive further comprises a controller. The controller is operative to, energise the radiation emitter to emit radiation, and determine a diameter data indicative of a diameter of a spool mounted on one of the first and second spool supports based on a radiation signal generated by the detector.

The radiation signal may be indicative of a direct radiation path between the emitter and the detector. That is, there may be a direct line of sight between the emitter and the detector. For example, radiation may travel directly from the emitter to the detector, with no intermediary surfaces reflecting the radiation, such as mirrors. The radiation path may be defined by the spool. For example, the radiation path may be defined by an outer diameter of the spool. The radiation path may be defined as a tangent to an outer diameter of the spool. Advantageously, the radiation path being defined by the spool allows the diameter of the spool to be determined even if the spool is not rotating.

The fixed positional relationship is such that the relative position of the emitter, detector and spool supports does not change during use, e.g. during printing. The radiation emitter, radiation detector and support spools may, for example, be permanently fixed to the body of the tape drive.

The fixed positional relationship of the radiation emitter, radiation detector and spool supports, allow a determination of diameter data (e.g. data relating to a diameter) of a spool to be determined based on radiation received at the detector emitted from the radiation emitter. For example, the fixed positional relationship of the radiation emitter, radiation detector, spool supports, and the diameter of a spool to be measured, may be such that when the emitter is energised, radiation from the emitter is either received at the detector or is not. No detection of the radiation emitted by the emitter may indicate that the diameter of the spool is greater than a certain value. For example, the spool may have a large enough diameter so as to fully block the radiation path between the emitter and detector (i.e. fully cast a shadow on the detector). Detection, by the detector, of the radiation emitted by the emitter may indicate that the diameter is less than a certain value. For example, the diameter of the spool may be such that the spool does not block the radiation path between the emitter and detector. Therefore, diameter data may be determined based on the radiation signal generated by the radiation detector.

The diameter data indicative of a diameter of a spool may be any suitable data relating to the diameter of the spool. The diameter data may be a calculation or approximation of the diameter or radius of the spool. The diameter data may by data which can be used to calculate or estimate the diameter of the spool. For example, the diameter data may comprise one or more coordinates, lengths, or angles, which may be used to calculate or approximate the diameter of the spool. The diameter data may also be data relating to how the diameter changes with time. For example, as a spool reduces, or increases, in diameter during printing, a shadow cast on the detector by the spool from radiation emitted from the emitter will move relative to the detector (due to the fixed positional relationship between the emitter, detector and spool support). Therefore, movement of the shadow may be used to determine that the diameter is decreasing or increasing.

The radiation emitter may be a light source such as an LED. The radiation detector may comprise an array of pixels, each pixel of the array configured to receive radiation and output a signal.

The controller may comprise one or more processors and may by implemented using software run on the one or more processors.

The spool may be a tape spool comprising ink carrying tape, also known as ribbon.

Advantageously, by providing a radiation emitter and a radiation detector having a fixed positional relationship with respect to the first and second spool supports in use, a determination of the diameter using the tape drive can be made at any time during printing since the use of the radiation emitter and radiation detector is independent of other printing/ribbon movement operations.

Optionally, the controller may be further operative to determine the diameter data based on predetermined positional data relating to the optical sensing system. For example, the predetermined positional data relating to the optical sensing system may be data indicative of the positions of the detector and/or emitter, and/or distances and/or angles between the detector and emitter. The predetermined positional data may be stored in a memory accessible by the controller or may be calculated by the controller based on any suitable method.

Optionally, the controller may be further operative to determine the diameter data based on predetermined positional data relating to one or both of the first and second spool supports. For example, the predetermined positional data relating to the one of the first or second spool supports may be data indicative of the position of the spool support. The predetermined positional data may be stored in a memory accessible by the controller or may be calculated by the controller based on any suitable method.

Optionally, the optical sensing system further comprises a plurality of radiation emitters. The controller may be further operative to energise the plurality of radiation emitters to each emit radiation. The controller may be further operative to determine a diameter data indicative of a diameter of a spool mounted on one of the first and second spool supports based on a plurality of radiation signals generated by the detector.

The plurality of radiation signals may be indicative of two or more direct radiation paths between two or more emitters and the detector. The radiation paths may be defined by the spool, such as an outer diameter of the spool as described above.

The plurality of radiation emitters may be arranged in a linear array. The direction of the array may be along a direction perpendicular to a rotational axis of one or both of the spools. The direction of the array may be parallel to a direction of the travel of tape between the first and second spools. Each radiation emitter may have a fixed positional relationship in use with respect to said first and second spool supports and radiation detector. Each emitter may be energised in turn while the other emitters are de-energised. For each energisation, a corresponding radiation signal generated by the detector can be determined. The radiation signal generated for each emitter when energised may be dependent on the diameter of the spool. For example, some of the emitters may, when energised, emit radiation which is prevented from being incident on the detector by a spool of a given diameter, whereas other emitters, when energised, emit radiation which is not prevented by the spool of the given diameter from being incident on the detector.

Advantageously, using multiple emitters can provide more accurate diameter data, and can lead to a quicker determination of a diameter over methods where an emitter or detector is located on a carriage of a printer, where the diameter is determined while the carriage is moving. Furthermore, using a plurality of emitters reduces the effect that a failure of one of the emitters may have on the determination of the diameter data.

A plurality of radiation detectors may be used with one radiation emitter, or a plurality of radiation emitters. The plurality of radiation detectors may be arranged in a linear array as described for the plurality of emitters.

Optionally, the controller is further operative to determine a feature of the one or more radiation signals, and determine, for each one of the one or more radiation signals, diameter data indicative of the diameter of the spool based on the respective feature of the one or more radiation signals.

The radiation signals generated by the detector may contain features which can be used to determine diameter data. For example, the feature may be related to a shadow cast on the detector by the spool from radiation emitted by an emitter. Therefore, multiple emitters may generate multiple radiation signals, and each radiation signal may be used to determine diameter data.

Optionally, the feature may be positional data relating to the one or more radiation signals. For example, the feature may be a position of an edge of a shadow cast on the detector by the spool.

Optionally, the positional data may comprise data relating to a boundary, the boundary separating a first region of the detector from a second region of the detector, where the first region corresponds to a region which receives a first level of radiation from an emitter and the second region corresponds to a region which receives a second level of radiation from the emitter. That is, the boundary may be the edge of a shadow on the detector cast by the spool when a given emitter is energised to emit radiation. The first level of radiation may be a level of radiation incident on the detector directly from the emitter. The second level of radiation may be no radiation directly incident from the emitter on the detector, i.e. because the second region is in the shadow cast by the spool. The positional data may be the location of the boundary. The location may be the relative location with respect to the detector, and/or may be the location of the boundary with respect to other features of the tape drive.

Optionally, the controller may be further operative to determine an average value of the diameter data, the average value being based on each of the diameter data generated using each one of the one or more radiation signals.

For example, as described above, multiple emitters may generate multiple respective radiation signals, and each radiation signal may be used to determine diameter data. Therefore, there may be multiple determinations of diameter data corresponding to the multiple emitters. For example, if three emitters are used, and three radiation signals are generated, there will be three sets of diameter data. This could, for example, be three separate calculated values of the diameter of the spool. An average of the three separate values of the diameter may be determined so as to arrive at a more accurate determination of the diameter of the spool.

Optionally, the controller may be further operative to apply a weighting factor to each of the diameter data generated using each one of the one or more radiation signals. For example, using the example above of three separate values of the diameter being calculated based on using three emitters, a weighted average may be determined by applying a weighting factor to each of the separate values of the diameter.

Optionally, the weighting factor applied to each of the diameter data may be dependent on the feature of the respective radiation signal. For example, where the feature of the respective radiation signal is positional data, such as a position of a boundary as described above, the weighting may be dependent on the positional data, e.g. dependent on the position of the boundary on the detector. For example, a diameter data determined from a signal with a boundary that is located at or near the centre of the detector may be giving more weight than a diameter data determined from a signal with a boundary that is located at or near the edge of the detector.

Optionally, the controller may be further operative to energise one or more of the plurality of the radiation emitters such that each one of the one or more of the plurality of the radiation emitters emits radiation a plurality of times, and use a plurality of radiation signals generated by the detector for a given emitter to determine the feature of the radiation signal.

For example, an emitter may be energised and de-energised a number of times to produce a number of radiation signals at the detector. Each of these radiation signals generated using the emitter may be used to determine the feature of the radiation signal. For example, if the feature is positional data, such as a position of a boundary caused by a shadow of the spool, each radiation signal may be used to determine the position of the boundary. For example, each of the radiation signals for a given emitter may be combined to better determine the position of the boundary.

Optionally, the controller may be further operative to subtract a background noise signal from each of the plurality of radiation signals generated by the detector for a given emitter to obtain a plurality of filtered signals for the given emitter, and determine the feature of the radiation signal using the plurality of filtered radiation signals for the given emitter. For example, a background noise signal may be generated by the detector when no emitters are energised, i.e. the background noise signal is indicative of background radiation received at the detector when the emitters are not energised. The background noise signal may then be subtracted from the detected radiation signals generated when the one or more emitters are energised.

Optionally, the controller may be further operative to determine a plurality of background noise signals, each one of the background noise signals being determined prior to, or after, detection of each one of the plurality of radiation signals for the given emitter. The controller may be further operative to subtract each respective one of the background noise signals from each respective one of the plurality of radiation signal for the given emitter.

For example, prior to energising a given emitter, a first background signal may be determined. The given emitter is then energised a first time to generate a first radiation signal at the detector. The first background signal may then be subtracted from the first radiation signal. Before the given emitter is energise a second time, a second background signal may be determined. Once the given emitter is energised a second time to generate a second radiation signal at the detector, the second background signal may then be subtracted from the second radiation signal. In other words, the background is measured between each flash of the given emitter, and so can be determined immediately before, or after, a given energisation of an emitter. This is advantageous as the background is monitored more regularly meaning that if the background noise changes during a measurement cycle (i.e. during multiple flashes of the emitter), the change in background is taken into account when removing the background noise.

Optionally, the controller is configured to determine the diameter data when the tape spool is at a plurality of angular positions so as to obtain diameter data for each of the angular positions.

For example, the controller may determine the diameter of the spool when the spool is arranged in a particular orientation. That is, the determined diameter will be along a particular axis of the spool dependent on the spool's angular orientation. The controller may repeat the determination of the diameter when the spool has rotated through a given angle so as to obtain second value of the diameter. That is, the second value of the determined diameter will be the diameter along a second axis of the spool. Assuming that the spool is a perfect circle, the measured diameters will be equal. However, eccentricity in the spool can lead to different values of the diameter when measured at different angular orientations. The diameter determined at each angular position may be combined to determine a diameter if the spool. For example, an average value of each diameter calculated at each angular orientation may be determined.

Optionally, the controller may be further configured to determine an eccentricity of the tape spool using the diameter data determined for each of the angular positions.

In a second aspect of the invention there is provided a method of using a tape drive according to the first aspect, and/or any optional features of the first aspect, to determine a diameter data item indicative of a diameter of a tape spool.

In a third aspect of the invention there is provided a thermal transfer printer comprising a tape drive according to the first aspect, and/or any optional features of the first aspect, arranged to transfer ink carrying tape between said first and second spools.

The thermal transfer printer further comprises a printhead arranged to transfer ink from said ink carrying tape to a substrate.

Embodiments of the invention will now be described, by way of example, with reference to the accompanying drawings, in which.

Figure 1:
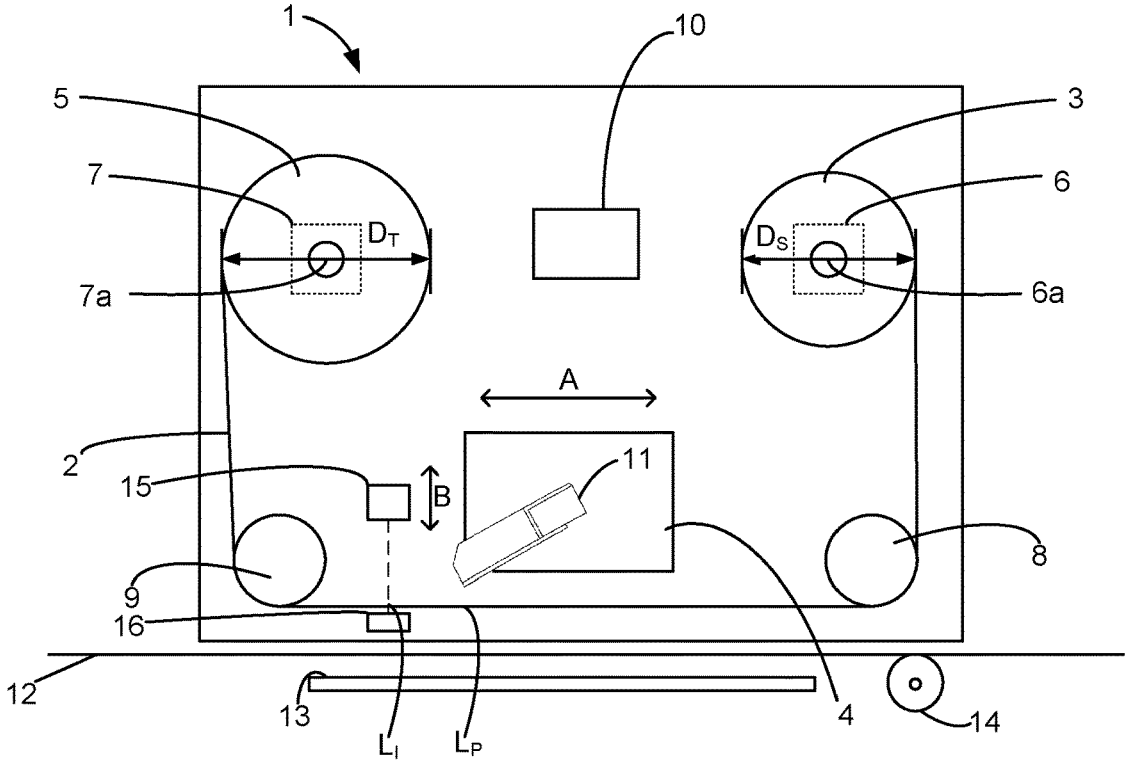
FIG. 1 is a schematic illustration of a printer n accordance with the present invention.
Figure 6A:
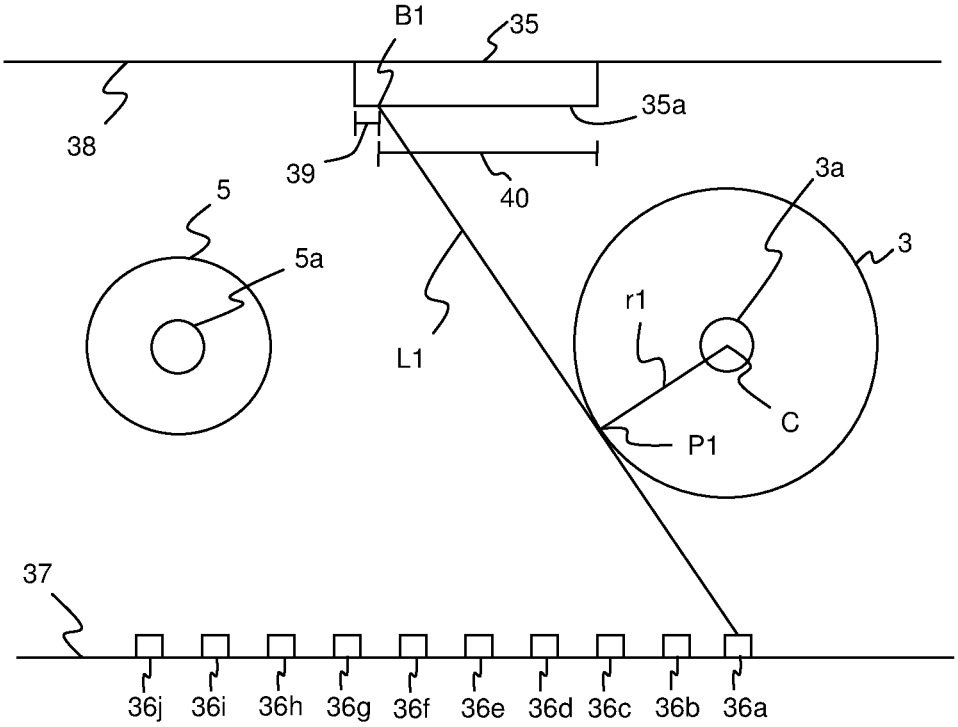
Figure 6B:
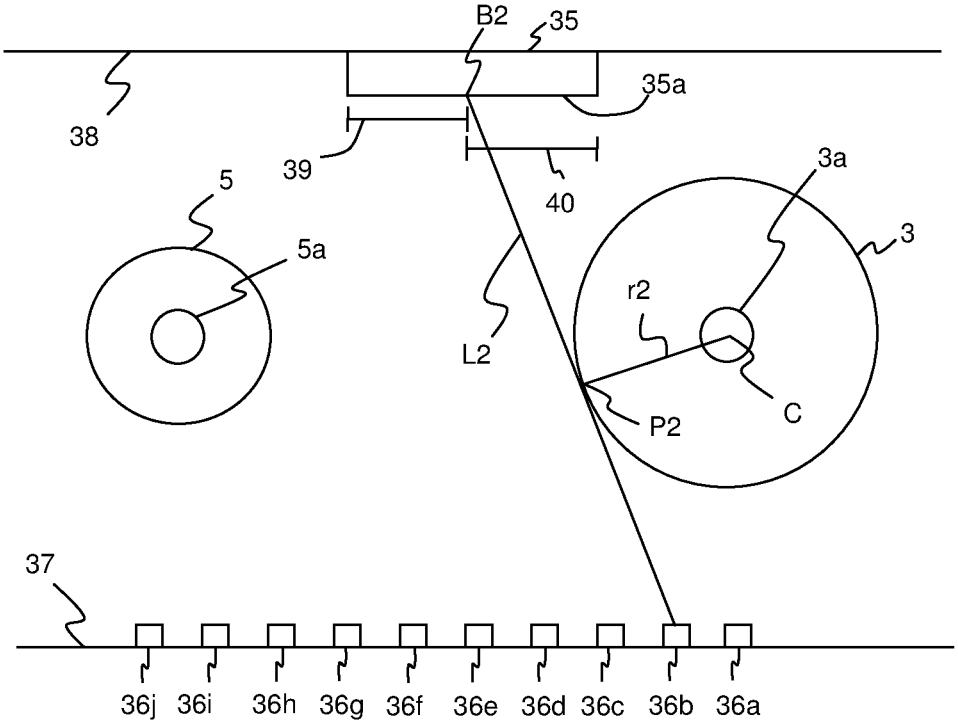
Figure 6C:
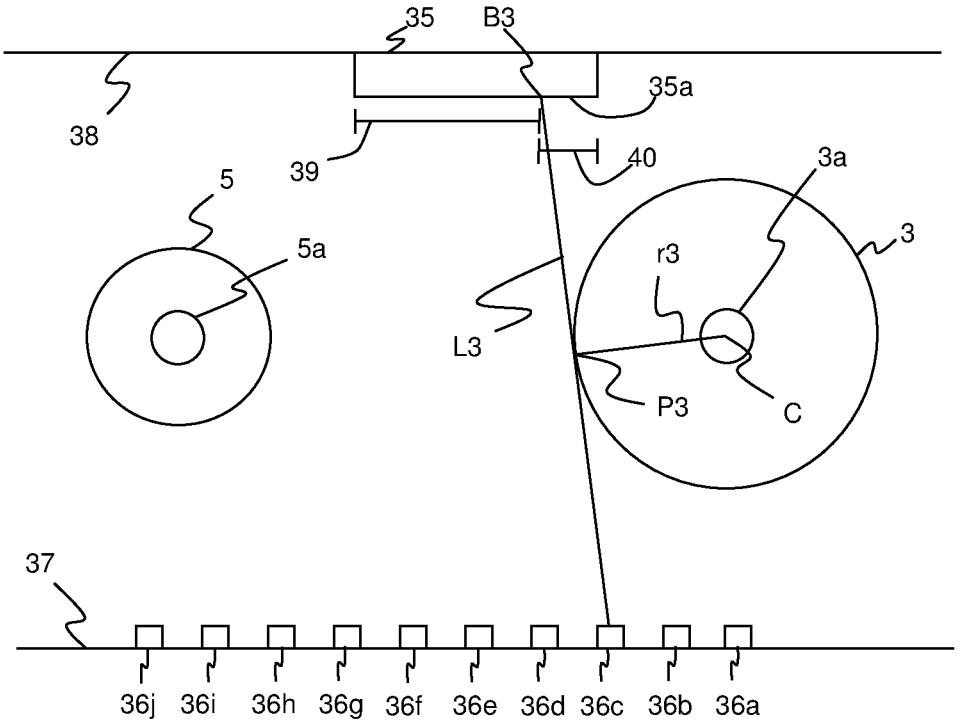
Figure 6D:
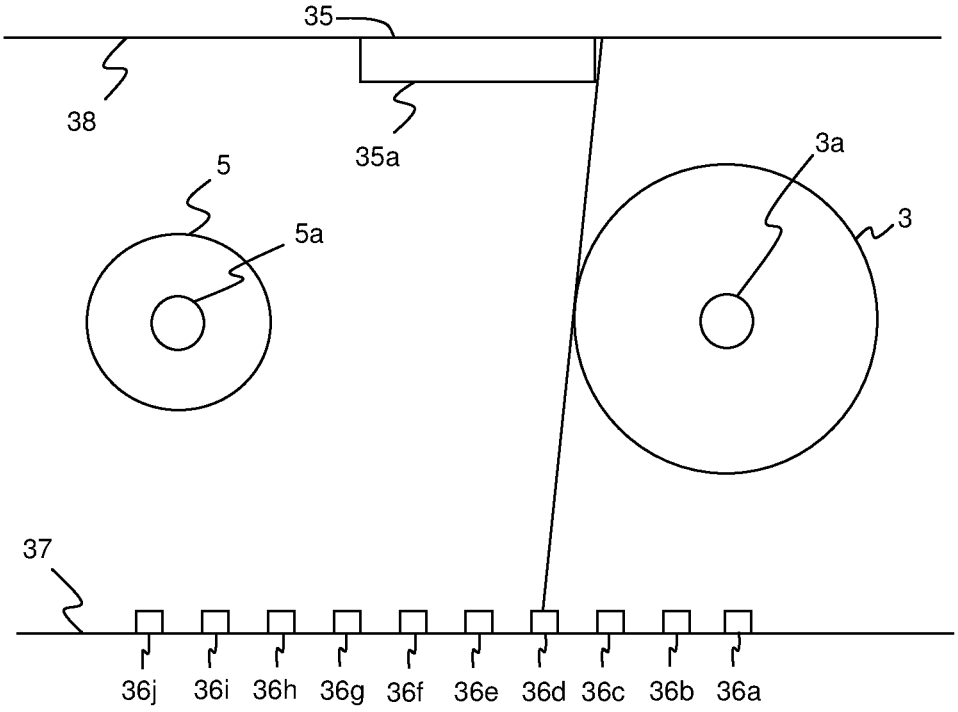
Figure 7:
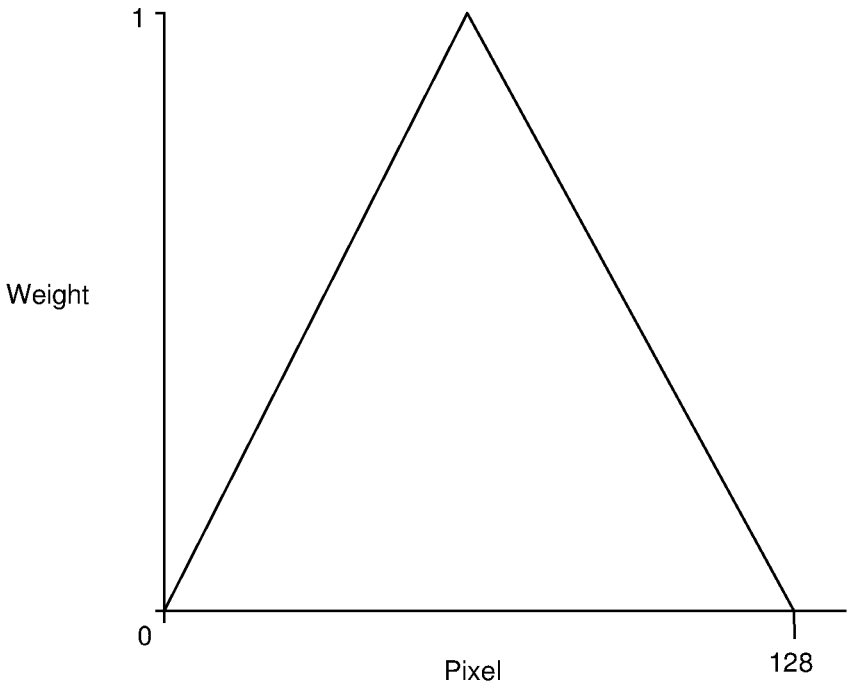
Figure 8A:
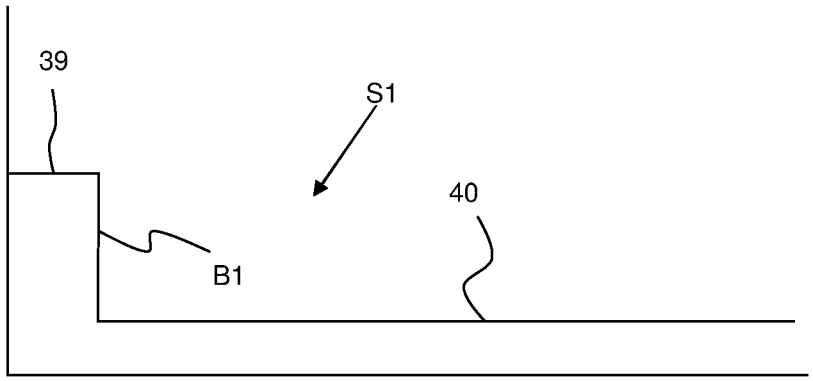

FIG. 6*a* is a schematic illustration of a tape drive of the printer of FIG. 1 when a first emitter is energised;

FIG. 6*b* is a schematic illustration of the tape drive of FIG. 6*a* when a second emitter is energised;

FIG. 6*c* is a schematic illustration of the tape drive of FIG. 6*a* when a third emitter is energised;

FIG. 6*d* is a schematic illustration of the tape drive of FIG. 6*a* when a forth emitter is energised;

FIG. 7 is a schematic plot of an example weighting function;

FIG. 8*a* is a schematic plot of a signal output generated by the tape drive of FIG. 6*a;*

Figure 8B:
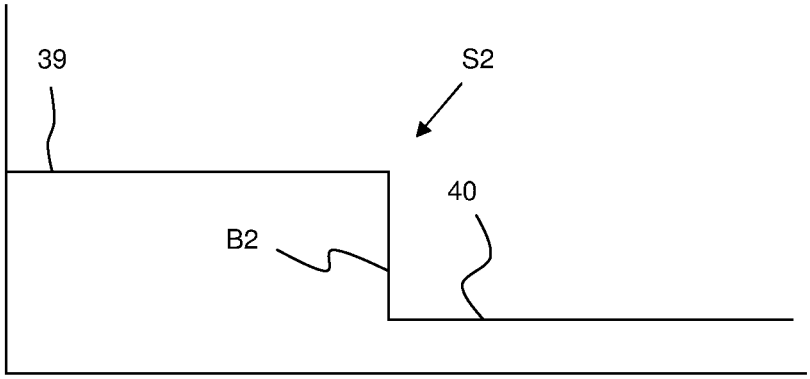

FIG. 8*b* is a schematic plot of a signal output generated by the tape drive of FIG. 6*b;*

Figure 8C:
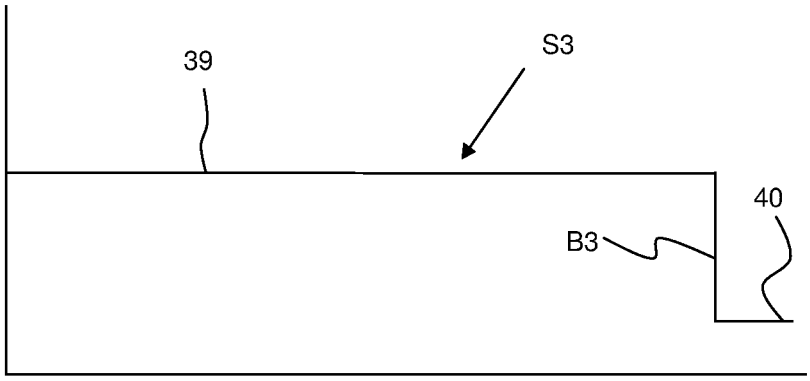
Figure 9:
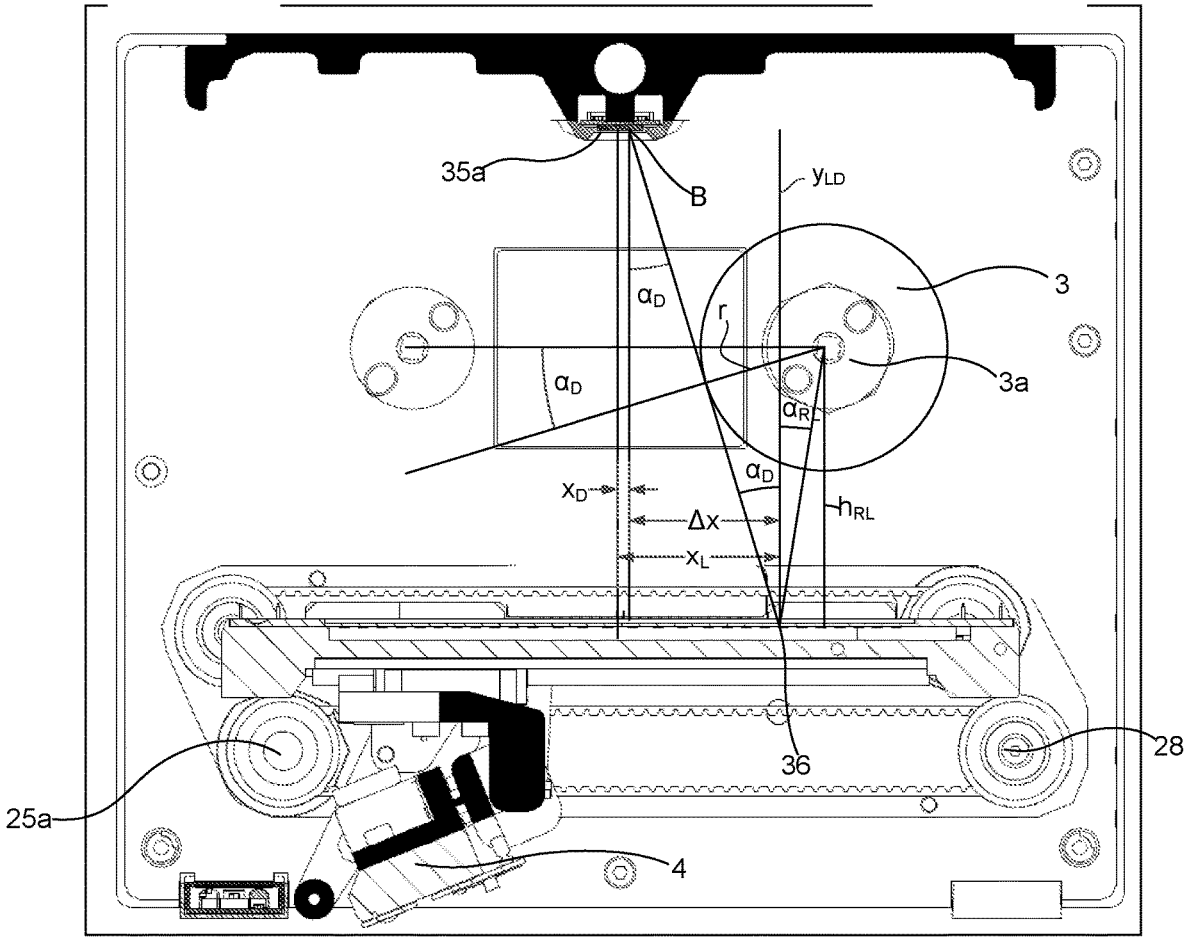

FIG. 8*c* is a schematic plot of a signal output generated by the tape drive of FIG. 6*c*; and FIG. 9 is a cut away side view of the printer of FIG. 1 showing relevant angles and lengths.

Referring to FIG. 1, there is illustrated a thermal transfer printer 1 in which ink carrying ribbon 2 is provided on a ribbon supply spool 3, passes a printhead assembly 4 and is taken up by a ribbon take-up spool 5. The ribbon supply spool 3 is shown as having diameter $D_S$ and the ribbon take up spool 5 is shown as having diameter $D_T$. The printer 1 comprises a tape drive, the tape drive comprising a ribbon supply spool support 3*a* (see FIGS. 6*a* to 6*d*) for supporting the ribbon supply spool 3 and a ribbon take-up spool support 5*a* (see FIGS. 6*a* to 6*d*) for supporting the ribbon take up spool. The tape drive further comprises stepper motor 6 and stepper motor 7. The ribbon supply spool 3 is driven by the stepper motor 6 while the ribbon take-up spool is driven by the stepper motor 7. The ribbon supply spool 3 is mounted on an output shaft 6*a*, via the ribbon supply spool support 3*a*, of stepper motor 6 while the ribbon take-up spool 5 is mounted, via the ribbon take up spool support 5*a*, on an output shaft 7*a* of stepper motor 7. The stepper motors 6, 7 may be arranged so as to operate in push-pull mode whereby the stepper motor 6 rotates the ribbon supply spool 3 to pay out ribbon while the stepper motor 7 rotates the ribbon take-up spool 5 so as to take up ribbon. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

During ribbon movement, ribbon paid out by the ribbon supply spool 3 passes a guide roller 8 before passing the printhead assembly 4 and a further guide roller 9 before being taken up by the ribbon take up spool 5. The motors 6, 7 are controlled by a controller 10. An encoder may be provided to generate a signal indicative of the position of the output shaft of one or both of the motors 6, 7. In an embodiment, an encoder 41 is provided to monitor the rotation of the take-up spool motor 7.

The printhead assembly 4 comprises a printhead 11 which presses the ribbon 2, and a substrate 12 against a printing surface 13 to effect printing. The location at which the ribbon 2 is pressed against the printing surface 13 by the printhead assembly 4 defines a printing location $L_P$. The printhead is a thermal transfer printhead comprising a plurality of printing elements, each arranged to remove a pixel of ink from the ribbon 2 and to deposit the removed pixel of ink on the substrate 12.

The printhead assembly 4 is moveable in a direction generally parallel to the direction of travel of the ribbon 2 and the substrate 12 past the printhead assembly 4, as shown by an arrow A. Thus, the printing location $L_P$ varies in accordance with the movement of the printhead assembly 4 in the direction A. Further, at least a portion of the printhead assembly 4 is moveable towards and away from the substrate 12, so as to cause the ribbon 2 (when passing the printhead 11) to move into and out of contact with the substrate 12, as shown by arrow B.

An encoder 14 may be provided which generates data indicative of the speed of movement of the substrate 12 at the printing location $L_P$. The printer 1 further comprises a camera 15 and a light source 16 arranged on opposing sides of the ribbon path.

Figure 2:
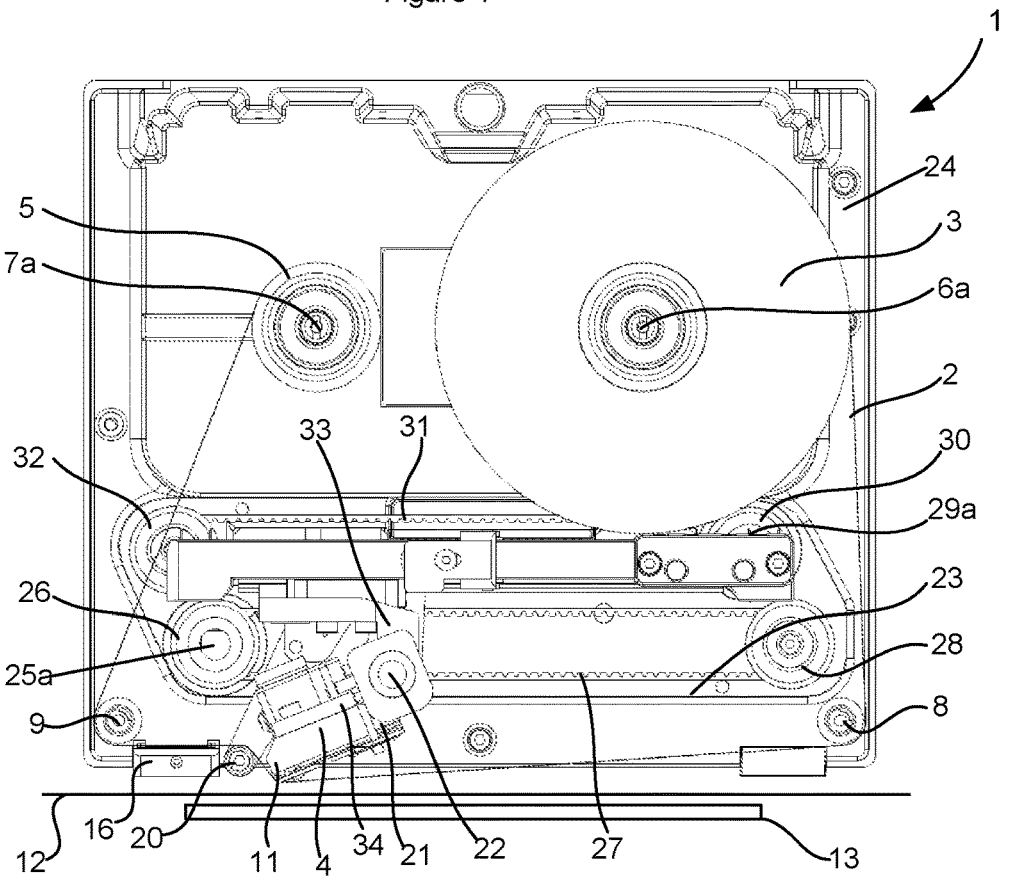
FIG. 2 is an illustration showing the printer of FIG. 1 in further detail.
Figure 3:
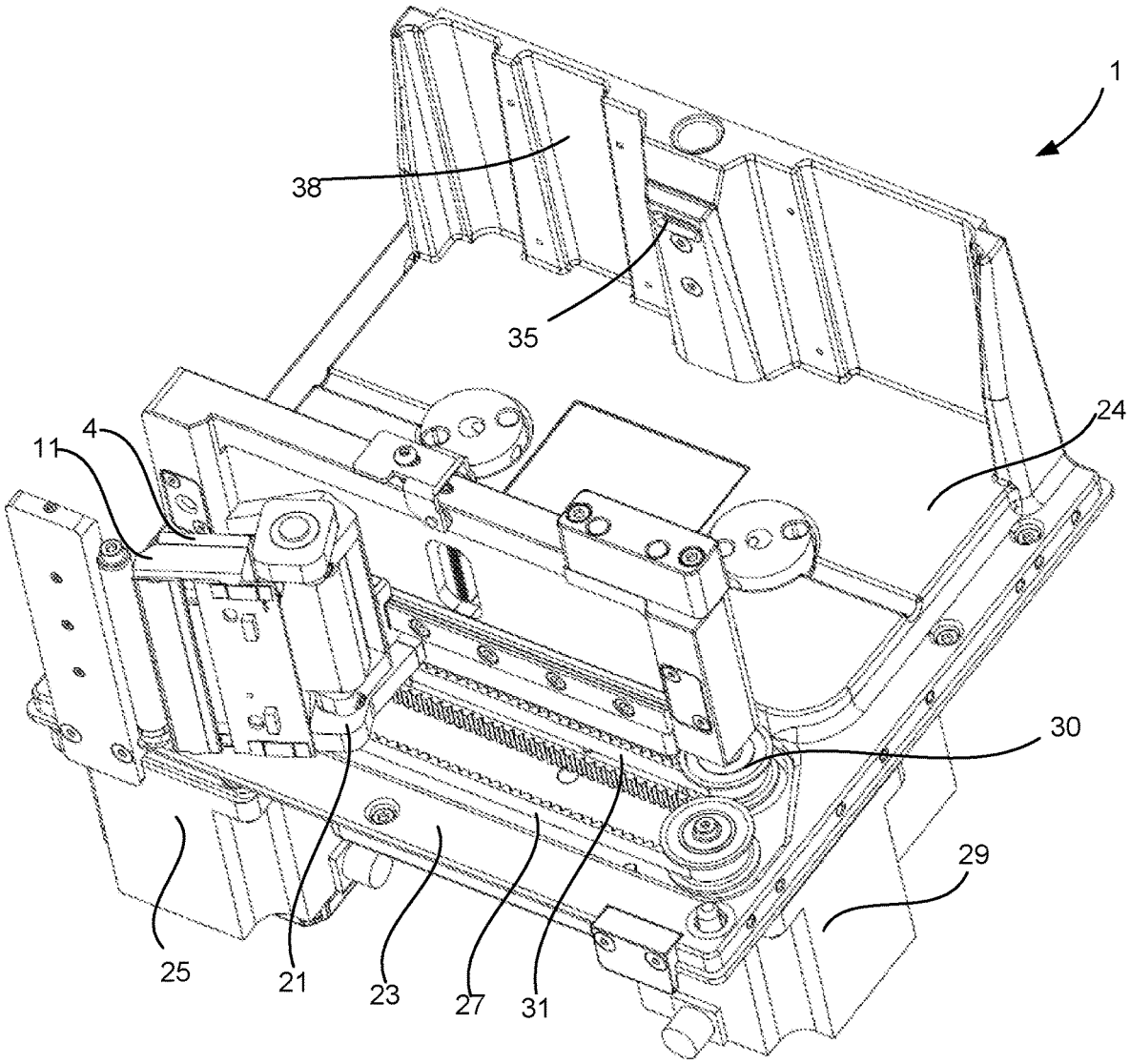
FIG. 3 is a perspective illustration showing the printer of FIG. 1 in further detail.
Figure 4:
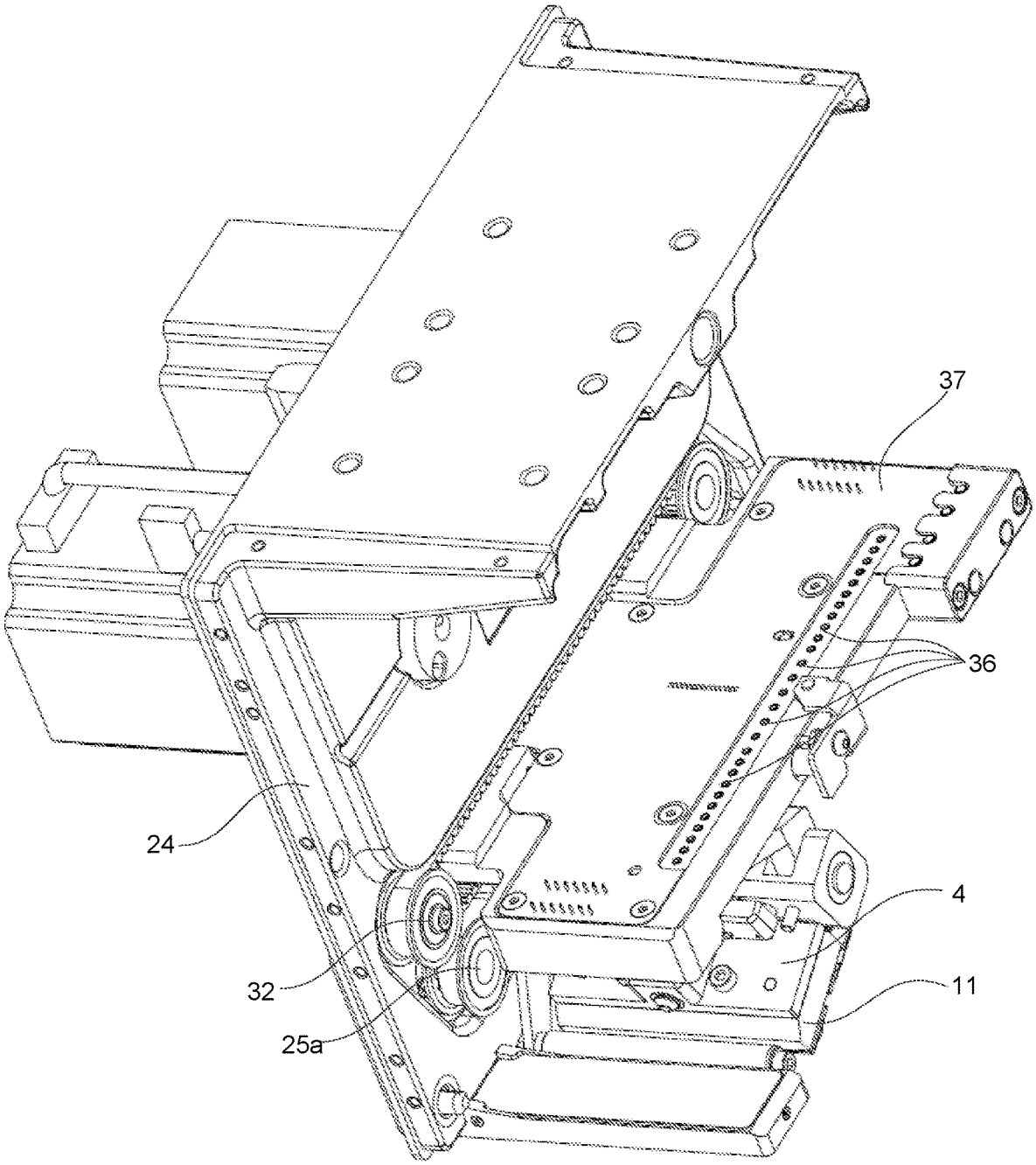
FIG. 4 is a further perspective illustration showing the printer of FIG. 1 in further detail.

Referring now to FIGS. 2, 3 and 4, the printer 1 is described in more detail. The printhead assembly 4 further comprises a guide roller 20, around which the ribbon 2 passes between the roller 9, and the printhead 11. The printhead assembly 4 is pivotally mounted to a printhead carriage 21 for rotation about a pivot 22 thereby allowing the printhead 11 to be moved towards or away from the printing surface 13. The printhead carriage 21 is displaceable along a linear track 23, which is fixed in position relative to a base plate 24 of the printer 1.

The position of the printhead carriage 21 in the direction of ribbon movement (and hence position of the printhead assembly 4) is controlled by a carriage motor 25. The carriage motor 25 is located behind the base plate 24 and drives a pulley wheel 26 that is mounted on an output shaft 25*a* of the carriage motor 25. The pulley wheel 26 in turn drives a printhead drive belt 27 extending around a further pulley wheel 28. The printhead carriage 21 is secured to the printhead drive belt 27. Thus rotation of the pulley wheel 26 in the clockwise direction drives printhead carriage 21 and hence the printhead assembly 4 to the left in FIG. 2 whereas rotation of the pulley wheel 26 in the counter-clockwise direction in FIG. 2 drives the printhead assembly 4 to the right in FIG. 2.

The movement of the printhead 11 towards and away from the printing surface 13 (and hence the pressure of the printhead against the ribbon 2, the substrate 12, and the printing surface 13) is controlled by a motor 29. The motor 29 is also located behind the base plate 24 (see FIG. 3) and drives a pulley wheel 30 that is mounted on an output shaft 29*a* of the motor 29. Movement of the printhead assembly 4 is controlled by appropriate control of the motors 25, 29 by the controller 10.

The motor 29 may be a stepper motor, and may be controlled in a closed loop manner by virtue of an encoder 42 which is associated with the motor shaft 29*a*. The encoder 42 may provide an output indicative of the angular position of the output shaft 29*a* of the motor 29. Such an output may be used to enable precise control of the motor 29, for example by controlling the stator field of the motor to have a predetermined angular relationship with respect to the motor shaft 29*a*.

The pulley wheel 30 in turn drives a printhead rotation belt 31 extending around a further pulley wheel 32. The printhead assembly 4 comprises a first arm 33, and a second arm 34, which are arranged to pivot about the pivot 22. The first arm 33 is connected to the printhead rotation belt 31, such that when the printhead rotation belt 31 moves the first arm 33 is also caused to move. The printhead assembly 4 is attached to the second arm 34. Assuming that the pivot 22 remains stationary (i.e. that the printhead carriage 21 does not move), it will be appreciated that movement of the printhead rotation belt 31, causes movement of the first arm 33, and a corresponding movement of the second arm 34 about the pivot 22, and hence the printhead assembly 4 (and printhead 11). Thus, rotation of the pulley wheel 30 in the clockwise direction drives the first arm 33 in to the left in FIG. 2, causing the second arm 34 to move in a generally downward direction, and the printhead assembly 4 to move towards the printing surface 13. On the other hand, rotation of the pulley wheel 30 in the counter-clockwise direction in FIG. 2 causes the printhead assembly 4 to move away from the printing surface 13.

The belts 27, 31 may be considered to be a form of flexible linkage. However, the term flexible linkage is not intended to imply that the belts behave elastically. That is, the belts 27, 31 are relatively inelastic in a direction generally parallel to the direction of travel of the ribbon 2 and the substrate 12 past the printhead assembly 4 (i.e. the direction which extends between the pulley wheel 30 and the further pulley wheel 32). It will be appreciated, of course, that the belts 27, 31 will flex in a direction perpendicular to the direction of travel of the ribbon 2 and the substrate 12 past the printhead assembly 4, so as to allow the belts 27, 31 to move around the pulleys 26, 28, 30, 32. Further, the printhead rotation belt 31 will flex in a direction perpendicular to the direction of travel of the ribbon 2 and the substrate 12 past the printhead assembly 4, so as to allow for the arc of movement of the first 33 arm about the pivot 22.

However, in general, it will be understood that the relative inelasticity ensures that any rotation of the pulley wheel 30 caused by the motor 29 is substantially transmitted to, and causes movement of, the first arm 33, and hence the printhead 11. The belts 27, 31 may, for example, be polyurethane timing belts with steel reinforcement. For example, the belts 27, 31 may be AT3 GEN III Synchroflex Timing Belts manufactured by BRECOflex CO., L.L.C., New Jersey, United States.

The arc of movement of the printhead 11 with respect to the pivot 22 is determined by the location of the printhead 11 relative to the pivot 22. The extent of movement of the printhead 11 is determined by the relative lengths of the first and second arms 33, 34, and the distance moved by the printhead rotation belt 31. Thus, by controlling the motor 29 to cause the motor shaft 29*a* (and hence pulley wheel 30) to move through a predetermined angular distance, the printhead 11 can be moved by a corresponding predetermined distance towards or away from the printing surface 13.

It will further be appreciated that a force applied to the first arm 33 by the printhead rotation belt 31 will be transmitted to the second arm 34 and the printhead 11. Thus, if movement of the printhead 11 is opposed by it coming into contact with a surface (such as, for example, the printing surface 13), then the force exerted by the printhead 11 on the printing surface 13 will be determined by the force exerted on the first arm 33 by the printhead rotation belt 31—albeit with necessary adjustment for the geometry of the first and second arms 33, 34. Further, the force exerted on the first arm 33 by the printhead rotation belt 31 is in turn determined by the torque applied to the printhead rotation belt 31 by the motor 29 (via pulley wheel 30).

Thus, by controlling the motor 29 to output a predetermined torque, a corresponding predetermined force (and corresponding pressure) can be established between the printhead 11 and the printing surface 13. That is, the motor 29 can be controlled to move the printhead 11 towards and away from the printing surface 13, and thus to determine the pressure which the printhead applies to the printing surface 13. The control of the applied pressure is important as it is a factor which affects the quality of printing. Of course, in some embodiments, the motor 29 may also be controlled in a conventional (i.e. open-loop position-controlled way).

It is also noted that the position of the printhead 11 with respect to the printing surface 13 is also affected by the motor 25. That is, given the relationship between the motor 25 and the printhead assembly 4 (i.e. the coupling of the motor 25, via the belt 27 to the printhead carriage 21), movement of the motor 25 also has an impact on the position of the printhead relative to the printing surface 13.

The motor 25 may also be a stepper motor, and may be controlled in a conventional (i.e. open-loop) manner. Of course, the motors 25, 29 may be other forms of motor (e.g. DC servo motors) which can be controlled in a suitable manner to control the position of the printhead 11 and printhead assembly 4.

In a printing operation, ink carried on the ribbon 2 is transferred to the substrate 12 which is to be printed on. To effect the transfer of ink, the print head 11 is brought into contact with the ribbon 2. The ribbon 2 is also brought into contact with the substrate 12. The printhead 11 is caused to move towards the ribbon 2 by movement of the print head assembly 4, under control of the controller 10. The print head 11 comprises printing elements arranged in a one-dimensional linear array, which, when heated, whilst in contact with the ribbon 2, cause ink to be transferred from the ribbon 2 and onto the substrate 12. Ink will be transferred from regions of the ribbon 2 which correspond to (i.e. are aligned with) printing elements which are heated. The array of printing elements can be used to effect printing of an image on to the substrate 12 by selectively heating printing elements which correspond to regions of the image which require ink to be transferred, and not heating printing elements which require no ink to be transferred.

There are generally two modes in which the printer 1 can be used, which are sometimes referred to as a "continuous" mode and an "intermittent" mode. In both modes of operation, the apparatus performs a regularly repeated series of printing cycles, each cycle including a printing phase during which ink is transferred to the substrate 12, and a further non-printing phase during which the printer is prepared for the printing phase of the next cycle.

In continuous printing, during the printing phase the print head 11 is brought into contact with the ribbon 2, the other side of which is in contact with the substrate 12 onto which an image is to be printed. The print head 11 is held stationary during this process—the term "stationary" is used in the context of continuous printing to indicate that although the print head will be moved into and out of contact with the ribbon, it will not move relative to the ribbon path in the direction in which ribbon is advanced along that path. Both the substrate 12 and ribbon 2 are transported past the print head, generally but not necessarily at the same speed.

Generally only relatively small lengths of the substrate 12 which is transported past the printhead 11 are to be printed upon and therefore to avoid gross wastage of ribbon it is necessary to reverse the direction of travel of the ribbon between printing cycles. Thus in a typical printing process in which the substrate is traveling at a constant velocity, the print head is extended into contact with the ribbon only when the print head 11 is adjacent regions of the substrate 12 to be printed. Immediately before extension of the print head 11, the ribbon 2 must be accelerated up to for example the speed of travel of the substrate 12. The ribbon speed is then generally maintained at a speed which is based upon the speed of the substrate (e.g. equal to, or proportional to the speed of the substrate 12) during the printing phase and, after the printing phase has been completed, the ribbon 2 must be decelerated and then driven in the reverse direction so that the used region of the ribbon is on the upstream side of the print head 11.

As the next region of the substrate to be printed approaches, the ribbon 2 is then accelerated back up to the normal printing speed and the ribbon 2 is positioned so that an unused portion of the ribbon 2 close to the previously used region of the ribbon is located between the print head 11 and the substrate 12 when the print head 11 is advanced to the printing location $L_P$. It is therefore desirable that the supply spool motor 6 and the take-up spool motor 7 can be controlled to accurately locate the ribbon so as to avoid a printing operation being conducted when a previously used portion of the ribbon is interposed between the print head 11 and the substrate 12.

In intermittent printing, a substrate is advanced past the printhead 11 in a stepwise manner such that during the printing phase of each cycle the substrate 12 and generally but not necessarily the ribbon 2 are stationary. Relative movement between the substrate 12, the ribbon 2 and the printhead 11 are achieved by displacing the printhead 11 relative to the substrate and ribbon. Between the printing phases of successive cycles, the substrate 12 is advanced so as to present the next region to be printed beneath the print head and the ribbon 2 is advanced so that an unused section of ribbon is located between the printhead 11 and the substrate 12. Once again accurate transport of the ribbon 2 is necessary to ensure that unused ribbon is always located between the substrate 12 and printhead 11 at a time that the printhead 11 is advanced to conduct a printing operation. It will be appreciated that where the intermittent mode is used, the printhead assembly 4 is caused to move along the linear track 23 so as to allow its displacement along the ribbon path.

In each of the aforementioned modes, during the transfer of tape from the supply spool 3 to the take up spool 5, both the supply spool motor 6 and the take-up spool motor 7 are energised in the same rotational direction. That is, the supply spool motor 6 is energised to turn the supply spool 3 to pay out an amount of tape while the take-up spool motor 7 is energised to turn the take-up spool 5 to take-up an amount of tape. The motors 6, 7 can therefore be said to operate in "push-pull" mode, with both motors being operated in a position (or speed) controlled manner. Where tension in the tape is to be maintained, it is important that the linear quantity of tape paid out by the supply spool is essentially equal to the linear quantity of tape taken up by the take-up spool. Additionally, as noted above it is desirable to transport a predetermined linear distance of tape between spools. This requires knowledge of the diameters of the spools given that the drive is applied to the spools and the linear length of tape transferred by a given rotational movement of the spools will vary in dependence upon the spool diameters.

The tape drive of the printer 1 comprises a linear array of twenty eight radiation emitters 36 and a radiation detector 35 (not all of the emitters are referenced in FIG. 4 for clarity). It will be appreciated that any number of emitters 36, including one, may be used. The radiation emitters 36 and detector 35 can be used to determine diameter data relating to the supply spool 3 and/or take up spool 5. The operation of the radiation emitters 36 and detector 35 will be described in more detail below. The radiation emitters 36 are arranged in a line along a first surface 37 of the tape drive, the first surface 37 extending out of the plane of the back plate 24, and the radiation detector 35 is arranged on a second surface 38, the second surface extending out of the plane of the back plate 24 and being opposite to the first surface 37. The spools 3, 5 are arranged so as to be mounted between the radiation emitters 36 and detector 35. It will be appreciated during the following description that the spools 3, 5 need only be between a radiation path created between the emitters 36 and detector 35, an effect that can also be achieved by using one or more mirrors (e.g. the emitters 36 and detector 35 could be located on the first surface 37, and a mirror located on the second surface 38 so as to reflect radiation back from the emitters 36 to the detector 35). It is however advantageous not to use a mirror, but rather to create a direct radiation path between the emitters 36 and detector 35. Placing an intermediary surface, such as a mirror, within the radiation path increases the complexity of the optical sensing system, and increases the chance of a degraded radiation signal being detected by the detector 35. For example, material, such as dust, may settle on the surface of the mirror, and such material may absorb a portion of, or in extreme cases all of, the radiation.

In the embodiment shown in FIG. 4, the spacing between each of the radiation emitters 36 is not uniform along the length of the array. The emitters 36 located towards the middle of the array are spaced further apart than the emitters 36 located towards the edges of the array. As will become apparent later, fewer emitters 36 are required in the middle portion of the array than at the edges of the array in order to determine diameter data. Of course, equal spacing between each emitter 36 can be used.

Figure 5:
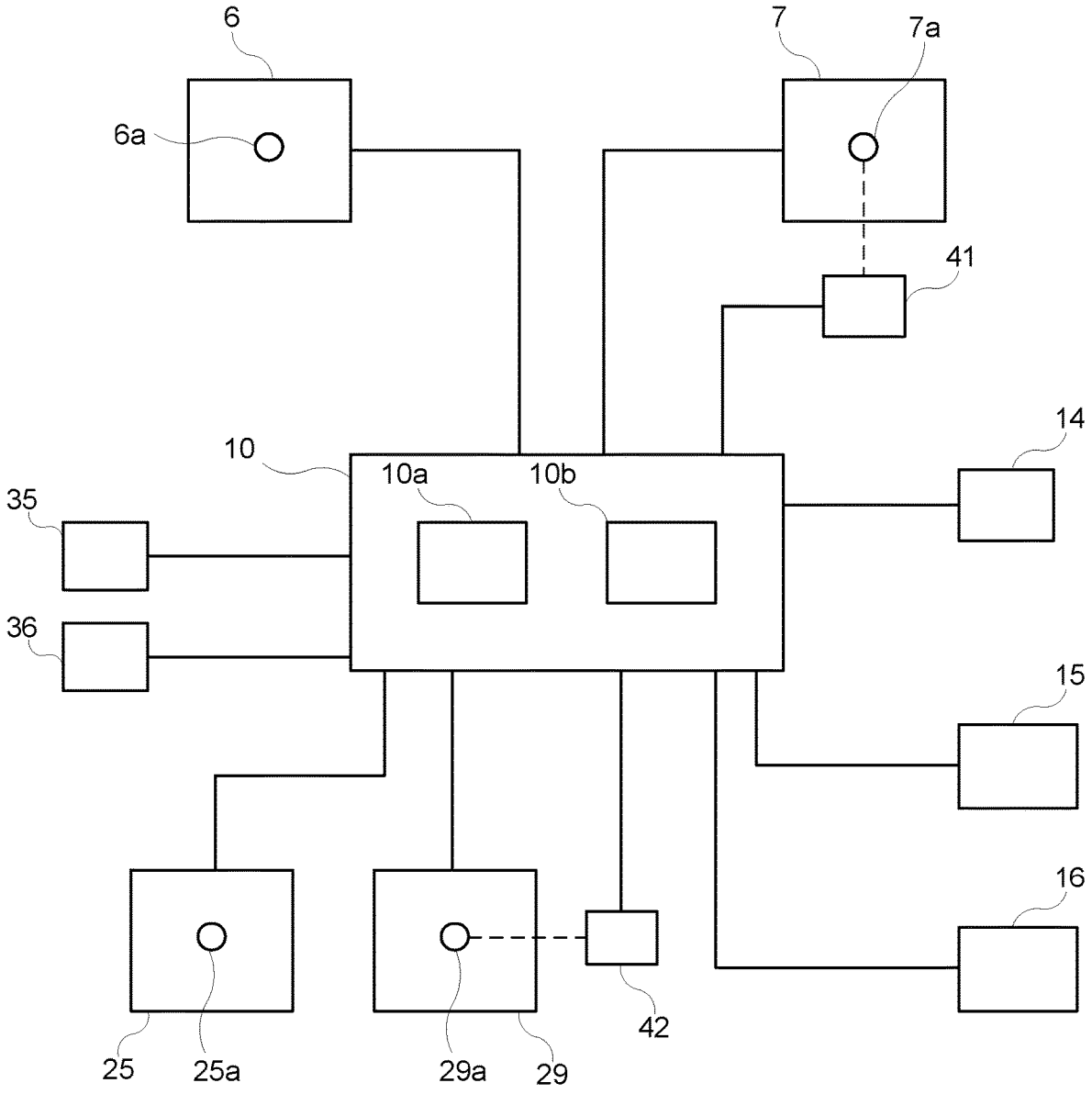
FIG. 5 is a schematic illustration of a controller arranged to control components of the printer of FIG. 1.

FIG. 5 is a schematic illustration of components involved in the control of the printer 1. The controller 10 comprises a processor 10*a* and a memory 10*b*. The processor 10*a* reads instructions from the memory 10*b*. The processor 10*a* also stores data in and retrieves data from the memory 10*b*. The motors 6, 7, 25, 29 are controlled by control signals generated by the controller 10. The controller 10 receives signals from the encoder 41, which signals are indicative of rotational movement of the motor 7. The controller also receives signals from the encoder 14, which signals are indicative of linear movement of the substrate 12 past the printer 1. The controller 10 also receives signals output from the detector 35 and controls the radiation emitters 36. The controller 10 may use signals output by the detector to determine diameter data of one or both of the spools 3, 5, and drive one or more of the motors 6, 7, 25, 29 based on the diameter data.

Referring to FIGS. 6*a* to 6*d* there is described a method of operating a tape drive so as to determine a diameter of a spool. It will be appreciated that FIGS. 6*a* to 6*d* are not to drawn to scale.

FIG. 6*a* shows a schematic illustration of the tape drive of the printer 1. While only ten radiation emitters 36*a*-36*j* are shown, it will be appreciated that any number of emitters 36 may be used, such as 28 as shown in FIG. 4. In an embodiment, the radiation emitters 36 are LEDs. The colour of light emitted by the LEDs may be any suitable colour. For example, the colour may be dependent on characteristics of the detector 35, such as the sensitivity of the detector 35 to particular wavelengths.

In an embodiment the detector 35 is a charge-coupled device (CCD). The detector 35 comprises a detection surface 35*a* capable of detecting radiation. In an embodiment the detection surface 35*a* comprises an array of discrete pixels, each pixel comprising a photodiode. For example, the detection surface 35*a* may comprises a 128×1 pixel array (e.g. the detector may comprise a TSL1401CL, manufactured by ams AG, of Unterpremstätten, Austria). An analogue output from the 128 pixels is passed to an ADC chip (e.g. AD 7278, manufactured by Anaog Devices Inc, of Norwood, Mass.). The ADC chip may provide a 128-bit serial data output via an SPI interface, each having 8-bits of intensity data per pixel of the sensor. In an embodiment, the 128 pixels of the detector 35 are aligned parallel to the linear array of emitters 36.

The controller 10 (not shown in FIGS. 6*a* to 6*d*) is arranged to energise each emitter 36 in turn and determine diameter data from one or more radiation signals output at the detector 35.

Referring to FIG. 6*a*, the controller 10 energises a first emitter 36*a* to emit radiation. A portion of the radiation emitted from the first emitter 36*a* is incident upon the detection surface 35*a* of the detector 35 in a first region 39. A second region 40 of the detection surface 35*a* of the detector 35 does not receive radiation directly from the first emitter 36*a* since the supply spool 3 is partially obscuring the detector 35 from the first emitter 36*a*. In other words, the supply spool 3 casts a shadow on the detector 35. Path L1 illustrates the separation of the portion of the radiation from the first emitter 36*a* that is directly incident upon the detector 35 and the portion of the radiation which is not directly incident upon the detector 35. Path L1 is the tangent at point P1 of the supply spool 3. In other words, path L1 is a direct radiation path between the emitter 36*a* and the detector 35, where the path L1 is defined by the spool 3. The position at which path L1 intercepts the detection surface 35*a* of the detector 35 defines a boundary B1 on the detector 35, the boundary B1 separating the first region 39 from the second region 40.

The detector 35 generates a radiation signal based on the radiation incident on the detection surface 35*a*. That is, the radiation signal is indicative of path L1. FIG. 8*a* shows a schematic plot of a radiation signal S1 from the detector 35 when the first emitter 36*a* is energised, where the y axis corresponds to an intensity of radiation incident on the detection surface 35*a* and the x axis corresponds to the location along the length of the detection surface 35*a* (where the location could be pixel location). As can be seen, the boundary B1 separates the first region 39 where there is a relatively high intensity of radiation incident on the detector 35 from the second region 40 where there is a relatively low intensity of radiation incident on the detector 35. It will be appreciated that in practice the boundary may span a number of pixels, dependent on the resolution of the detector 35. For example, the intensity of radiation may drop off over about 3 to 5 pixels of the detector 35.

The controller 10 is configured to determine the location of the boundary B1 based on the radiation signal S1 output from the detector 35. For example, the detection surface 35*a* may comprise a number of pixels, such as 128, and the controller 10 may be configured to determine which pixels directly receive radiation from the radiation output by the first emitter 36*a* and which pixels do not directly receive radiation from the radiation output by the first emitter 36*a*. Based on the determination of which pixels directly receive radiation and which pixels do not directly receive radiation, the controller 10 can determine the location of the boundary B1.

If the boundary B1 extends over a number of pixels, such as 5, the position of the boundary B1 may be defined in any suitable way. For example, the position of the boundary B1 may be defined as the pixel nearest to the average value of the minimum and maximum values of intensity between the boundary B1. Alternatively, the position of the boundary B1 may be determined based on a threshold, such as the intensity of radiation being equal to or less than (or greater than) a predetermined value. Interpolation methods may be used on the radiation signal S1 to determine how the radiation signal S1 varies between discrete pixel values of the detector 10.

Once the position of the boundary B1 has been determined relative to the detector 35, the controller 10 may determine the position of the boundary B1 relative to the tape drive 1. The controller 10 may make this determination based on predetermined knowledge, such as the dimensions and/or specification of the detector 35 and the position of the detector 35 within the tape drive.

Based on the determined position of the boundary B1, the controller 10 can determine data indicative of a diameter of the supply spool 3. For example, a radius r1 of the supply spool 3 can be determined based on the known relative positions of the first emitter 36*a*, boundary B1, and centre C of the supply spool 3 using trigonometry. FIG. 9, along with description below, describes in more detail an example method of determining the radius r1 of the supply spool 3.

The controller 10 may determine the location of the boundary B1 and/or radius r1 after the controller has energised additional radiation emitters 36. For example, the controller 10 may wait to determine boundary B1 and radius r1 after all of the radiation emitters 36 have been energised in turn. Alternatively, the controller 10 may determine the location of the boundary B1 and/or radius r1 prior to energising any further emitters 36.

Further determinations of data indicative of the diameter of the supply spool 3 may be made using the additional emitters 36 of the array. Each determination of the diameter as determined for a particular emitter 36 may be combined with any other determination of the diameter by any other emitter 36. Combining multiple determinations of the diameter in this way can improve the robustness of the determination of the diameter of the supply spool 3.

Referring to FIG. 6*b*, the controller 10 de-energises the first emitter 36*a*, and energises a second emitter 36*b* to emit radiation. Due to the fact that the second emitter 36*b* is axially displace from the first emitter 36*a*, the shadow cast by the supply spool 3 on the detector 35 by the radiation of the second emitter 36*b* is axially shifted relative to the shadow cast by the supply spool 3 on the detector 35 by the radiation of the first emitter 36*a* (as shown in FIG. 6*a*). This leads to there being a larger first region 39 (i.e. more radiation is directly incident on the detector 35) and a smaller second region 40 than when using the first emitter 36*a*. In the example shown in FIG. 6*b*, path L2, which is the tangent at point P2 of the supply spool 3, intercepts the detector 35 to define boundary B2 towards a centre of the detector 35. In other words, path L2 is a direct radiation path between the second emitter 36*b* and the detector 35, where the path L2 is defined by the spool 3. A radiation signal S2 is generated by the detector 35, a schematic plot of which is shown in FIG. 8*b*. That is, the radiation signal S2 is indicative of path L2.

The controller 10 determines the position of the boundary B2 and, based on the determination of the position of boundary B2, the controller 10 determines data indicative of the diameter of the supply spool 3, such as radius r2 of the supply spool 3. As above, the controller 10 may determine boundary B2 and radius r2 after the controller has energised all of the radiation emitters 36 in turn. Note that the calculated values of radius r1 and radius r2 may differ slightly. This may be due to measurement error, for example.

Referring to FIG. 6*c*, the controller 10 de-energises the second emitter 36*b* and energises a third emitter 36*c* to emit radiation. In the example shown in FIG. 6*c*, path L3, which is the tangent at point P3 of the supply spool 3, intercepts the detector 35 to define boundary B3 towards the left edge (as viewed in FIG. 6*c*) of the detector 35. In other words, path L3 is a direct radiation path between the third emitter 36*c* and the detector 35, where the path L3 is defined by the spool 3. A radiation signal S3 is generated by the detector 35, a schematic plot of which is shown in FIG. 8*c*. That is, the radiation signal S3 is indicative of path L3.

The controller 10 determines the position of the boundary B3, and based on the determination of the position of boundary B3, the controller 10 determines data indicative of the diameter of the supply spool 3, such as radius r3 of the supply spool 3. As above, the controller 10 may determine boundary B3 and radius r3 after the controller has energised all of the radiation emitters 36 in turn.

Referring to FIG. 6*d*, the controller de-energises the third emitter 36*c* and energises a fourth emitter 36*d* to emit radiation. As can be seen in FIG. 6*d*, path L4 does not intercept the detector 35. That is, the detection surface 35*a* of the detector 35 is not in the shadow of the supply spool 3 when the fourth emitter 36*d* is energised. As no boundary is defined on the detection surface 35*a* of the detector 35, the information provided by the fourth emitter 36*d* is of limited use in determining an accurate value of the diameter of the supply spool 3. However, the fact that no shadow is cast on detector 35 indicates that the diameter of the supply spool 3 is less than a particular value. That is, the fact that no boundary is present on the detection surface 35*a* provides information about the diameter of the supply spool 3.

The controller 10 may continue to energise each of the remaining radiation emitters 36*e* to 36*j* in turn. Once all of the radiation emitters 36 have been energised, and the controller has determined radius values r1, r2 and r3 as described above, the controller may then determine the average value of r1, r2 and r3 to arrive at a more accurate determination of the radius of the supply spool 3.

Rather than energise each of the remaining radiation emitters 36*e* to 36*j* in turn, the controller 10 may, on the determination that the fourth emitter 36*d* does not create a boundary at the detector 35, cease energising the remaining emitters 36*e* to 36*j*.

Advantageously, by using a plurality of emitters 36, and determining diameter data based on measurements taken using the plurality of emitters 36, should a single emitter fail, a determination of diameter data can still be determined. For example, if the second emitter 36*b* fails, data from the first emitter 36*a* and third emitter 36*c* may be used to determine the diameter of the supply spool 3.

When calculating an average value of the radius, a weighting factor may be used. For example, it has been found by the inventors of the present invention that the location of boundary B1, B2, B3 on the detection surface 35*a* of the detector 35 has an effect on the determined radius r1, r2, r3. In particular, it has been found that determination of the diameter data in cases where the boundary is located towards the centre of the detection surface 35*a* of the detector 35 is generally more accurate than determinations of the diameter data where the boundary is located towards an edge of the detection surface 35*a* of the detector 35. Therefore, in an implementation, a weighting function may be applied which provides greater weight to diameter data determined from emitters 36 which create a boundary towards the centre of the detection surface 35*a* of the detector 35, and less weight to diameter data from emitters 36 which create a boundary towards an edge of the detection surface 35*a* of the detector 35.

The weighing function may take any suitable form. For example, the weighting function may take the form of an inverted V shape, as shown in the schematic plot of FIG. 6, where the x axis corresponds to a pixel position of a boundary on detector 35 (assuming a detector having a detection surface having a length of 128 pixels) and the y axis corresponds to the weighting applied, the weighting being between 0 or 1 in the example. As can be seen, a maximum weighting is applied to a boundary having a position at the middle of the detector 35. Alternatively, the weighting function may be bell shaped or dome shaped. Using a weighted average which reduces the weight of diameter data determined using a boundary at the edge of the detector also helps avoid any adverse effects caused by step changes when moving between emitters (i.e. as a shadow moves onto, or off, the detector due to increase/decrease in diameter of the spool).

The controller 10 may be arranged to determine the diameter (or radius) of the supply spool 3 at different angular orientations of the supply spool 3. That is, the controller 10 may energise each emitter 36 in turn while the supply spool 3 is at a first orientation so as to determine diameter data, such as the diameter of the supply spool 3. The controller 10 may then cause the supply spool 36 to be rotated by number of degrees to a second orientation, and then repeat the steps of energising each emitter 36 in turn while the supply spool is at the second orientation so as to determine additional diameter data. The controller may repeat this for a number of angular orientations of the supply spool 3. For example, the controller 10 may determine the diameter data of the supply spool 3 when the supply spool is at eight different angular orientations, separated by 45 degrees. The controller 10 may use the diameter data determined at each of the eight angular orientations to determine the diameter of the supply spool 3, such as by determining an average value of the diameter based on the diameter data determined while the supply spool 3 is at each of the angular orientations.

The controller 10 may be arranged to determine the diameter (or radius) of the supply spool 3 at different angular orientations of the supply spool 3 prior to printing. That is, the controller 10 may perform a calibration routine prior to printing, to determine the diameter of the supply spool. Once the initial diameter of the supply spool 3 has been determined, the printer 1 may carry out a printing operation, and the controller 10 may periodically monitor the diameter of the supply spool 3 (or take up spool 5) during printing. In an implementation, following calibration, the controller 10 identifies a subset of emitters 36 which produced a boundary on the detection surface 5*a*. In the example shown in FIGS. 6*a* to 6*d*, the subset would be emitters 36*a*, 36*b* and 36*c*. The controller 10 may then energise the subset, rather than every emitter 36, during printing.

As the diameter of the supply spool 3 changes, the subset of emitters 36 that produce a boundary B on the detection surface 35*a* of the detector 35 will change as the shadow cast by the spool 3 shifts. The controller 10 may be configured to update the emitters in the subset as emitters as the diameter of the spool 3 changes.

For example, when the supply spool 3 is first loaded into the printer 1, the emitters 36 located towards the middle of the emitter array, such as emitters 36*g*, 36*f*, 36*e* and 36*d*, may produce a boundary on the detection surface 35*a*, while the remaining emitters 36*a*-36*c* and 36*h* to 36*j* may not produce a boundary. Therefore, the controller 10 may identify emitters 36*d* to 36*g* as the subset, and energise these emitters initially during printing to determine the diameter of the spool 3 during printing. As the diameter of the supply spool 3 reduces in size as tape is taken off the supply spool 3, emitter 36*c* will begin create a boundary on the detection surface 35*a*, while emitter 36*g* will stop producing a boundary on the detection surface 35*a*. The controller 10 may therefore update the subset to remove emitter 36*g* and add emitter 36*c*. In this way, the emitters 36 that are used during ongoing measuring of the diameter during printing shift along the emitter array over time.

In an embodiment, the controller 10 may, after calibration, select a subset of emitters 36 to energise initially during printing. The number of emitters 36 in the subset may remain constant as the subset moves along the array of emitters 36. For example, five emitters 36 may be chosen for the subset, where some or all of the five emitters initially produced a boundary on the detection surface 35*a* during calibration.

How the subset is defined during ongoing measurements during printing may be based on the average position of the emitters which produce a boundary. For example, a central emitter of the subset may be determined based on calculating the average position of all of the emitters which produce a boundary. The average position may be found using the equation, (Sum of emitter positions which produce a boundary+(Number of emitters which produce boundary/2))/Number of emitters which produce boundary.

To illustrate, the controller 10 may initially define five emitters in the subset, such as during calibration. The five emitters may have positions 1, 2, 3, 4, 5 within the array of emitters, with the emitter in the position 3 being in the centre of the subset. The controller 10 may determine during printing that only emitters in positions 2, 3, 4, and 5 produce a boundary on the detection surface 35*a*. That is, the emitter in position 1 does not produce a boundary on the detection surface 35*a*. The controller 10 may use the above equation to determine a new centre of the subset. In this illustration, this would be ((2+3+4+5)+(4/2))/4=4. Therefore, the controller 10 would update the subset such that the emitter in position 4 is now at the centre of the subset. The newly updated subset would also now include the emitters located in positions 2, 3, 4, 5 and 6 (i.e. two emitters either side of the central emitter are contained in the subset). In this way, the subset will move across the array of emitters as the diameter of the spool changes. While the number of emitters in the subset may be fixed at five, as the subset of emitters reaches an edge of the array of emitters 36, the number may be reduced. For example, when the emitter determined to be at the centre of the subset corresponds to an emitter at the edge of the array (such as emitter 36*a*), only three emitters will be in the subset (36*a*, 36*b* and 36*c*).

Due to the geometry of the layout of the tape drive 1, fewer emitters 36 can be used in a central portion of the array of emitters than at the edges of the array in order to determine diameter data. That is, for a given change in diameter of a spool 3, 5, the change in shadow position projected on the detection surface 35*a* of the detector 35 from a central emitter 36, such as emitter 36*f*, is less than the change in shadow position projected on the detection surface 35*a* from an emitter located at the edge of the array, such as emitter 36*a*. As such, the emitters located towards the centre of the array may be more spaced out than emitters located towards the edge of the array.

It has so far been described that the controller 10 energises a given emitter 36 and uses the resulting radiation signal output by the detector to determine diameter data. In some implementations the controller 10 is arranged to use multiple radiation signals generated by the same emitter 36 to determine diameter data. In an implementation, the controller 10 repeatedly energises and de-energises a given emitter 36 (i.e. flashing the emitter 36 a number of times), to generate a number of radiation signals at the detector 35, before moving on to the next emitter in the array. Each of the radiation signals generated for a given emitter 36 can be combined to, for example, reduce the effect of noise and help determine whether a boundary exists in the radiation signals and/or the position of the boundary. That is, multiple radiation signals may be recorded for a given emitter 36, and each of these radiation signals can be used to determine a more accurate position of the boundary than if just one radiation signal is used. For example, combining each radiation signal for a given emitter can help reduce the effect of random noise in the radiation signal and increase the effect caused by the boundary. For example, an image stacking technique may be used to combine the radiation signals for a given emitter 36. Image stacking techniques are well known to the skilled person and so are not described in detail here.

The length of time that the emitters 36 are energised and de-energised may be any suitable time. In an implementation, the emitters 36 are energised for about 10 μs and then de-energised for about 10 μs before being energised again. The controller 10 may be arranged to flash each emitter 36 either a predetermined number of times, or until a condition is met before moving on to the next emitter 36.

Background noise may be removed from each radiation signal. This is advantageous in cases where the detector 35 is in a location where there may be a risk of ambient light hitting the detection surface 35. Removing background noise helps the controller 10 to determine the position of the boundary in the radiation signal for a given emitter 36.

The background noise may be determined a plurality of times. For example, the background noise may be determined immediately prior to, or immediately after, an energisation of an emitter 36. That is, prior to, or after, energising an emitter 36, a radiation signal indicative of the background noise (caused by, for example, ambient light incident on the detection surface 35*a*) may be determined. This allows a separate radiation signal indicative of the background noise to be determined for each energisation of a given emitter 36, and hence can be used to remove the background noise for each radiation signal generated during a given energisation of the emitter 36 so as to generate a filtered radiation signal for each energisation of the emitter 36. Each of the filtered radiation signals for a given emitter 36 may be combined as described above, such as by using image stacking, to generate a combined filtered radiation signal.

The combined radiation filtered signal may be used by the controller 10 to determine the position of the boundary on the detector 35 when energising a given emitter 36, and hence determine diameter data indicative of the diameter of the supply spool 3.

For example, a first background radiation signal may be generated by the detector when a first emitter 36 is not energised so as to determine a first ambient light profile. The first emitter 36 is then energised so as to emit radiation and generate a first radiation signal at the detector 35. The first background radiation signal may then be subtracted from the first radiation signal to generate a first filtered radiation signal. The first emitter 36 is then de-energised and a second background radiation signal is generated to determine a second background ambient light profile. The first emitter 36 is then energised to generate a second radiation signal at the detector 35. The second background radiation signal may then be subtracted from the second radiation signal to generate a second filtered radiation signal. The first and second filtered radiation signals may be summed using, for example, an image stacking method to generate a combined filtered radiation signal for the first emitter 36.

The method of generating and summing the filtered radiation signals to generate a combined filtered radiation signal for a given emitter may continue until a predetermined condition is satisfied. The predetermined condition may be that the method continues until the combined filtered radiation signal satisfied one of the following three conditions:

1. A difference between a maximum value and a minimum value representative of radiation intensity in the combined filtered radiation signal is less than a threshold. In an embodiment, the threshold may be about 6% of the total possible signal size. For example, where the maximum value of a pixel is 255 (assuming 8-bit is assigned to a pixel), then the threshold may be about 15). The minimum value may also have to satisfy a condition where the minimum value is less than a threshold that would be expected if radiation from the emitter was obscured by ribbon. In an embodiment, the threshold may be about 4% of the total possible signal, or about 10 assuming a maximum value of 255. Thus, the first condition stops the energising de-energising cycle of a given emitter 36 if the radiation from the emitter 36 is obscured by the spool.

2. A pixel is going to overflow, i.e. if the combination of further data to the combined filtered radiation signal would cause overflow of a pixel. This helps to prevent loss of information. For example, assuming that the first condition is met, each of the filtered radiation signals are continually combined to generate a combined filtered radiation signal. Each additional generation of a filtered radiation signal is combined with the combined filtered radiation signal until the point where if adding a new filtered radiation signal would cause a pixel of the combined filtered radiation signal to overflow (i.e. if a pixel has a value of greater than 255 when using 8 bit per pixel).

3. A total, such as thirty, filtered radiation signals have been generated, i.e. thirty background radiation signals and thirty radiation signals indicative of the radiation from the given emitter 36 have been captured (60 exposures total). The time range for capturing data and generating the radiation signals for a given emitter may be about 20 μs to 600 μs.

There will now be described, with reference to FIG. 9, a derivation of an equation for determining the radius r of a spool. FIG. 9 shows a cross section through the printer 1. The following parameters used in the derivation are defined as:

B—Boundary point indicating the edge of shadow cast by spool 3.

$\alpha_D$—Angle between the vertical and a tangential radiation ray from an energised emitter 36 to the detector 35 which intercepts the detector 35 at the boundary B.

$x_D$—Horizontal distance from a midpoint of the printer 1 to B.

$x_L$—Horizontal distance from the midpoint of the printer to the energised emitter 36.

$\Delta x = x_L - x_D$—Horizontal distance from B to the energised emitter 36.

$h_{RL}$—Vertical distance between the energised emitter 36 and the centre of the spool support 3*a*.

$y_{LD}$—Vertical distance between the energised emitter 36 and detector 35.

$\alpha_{RL}$—Angle between the vertical and $h_{RL}$.

$\alpha_T < \alpha_{RL} + \alpha_D$, which is the angle between the tangential radiation ray from the energised emitter 36 and $h_{RL}$.

r—The radius of the spool

The terms "vertical" and "horizontal" are used in relation to the orientation of FIG. 9.

Since a right angle is formed between the tangential radiation ray and the radius r.

$$\sin \alpha_T = \sin(\alpha_D + \alpha_{RL}) = \frac{r}{h_{RL}} \tag{1}$$

$\alpha_D$ is unknown since this is dependent on boundary point B. However:

$$\tan \alpha_D = \frac{\Delta x}{y_{LD}} \tag{2}$$

$$\alpha_D = \tan^{-1} \frac{\Delta x}{y_{LD}} \tag{3}$$

Which, when rearranged, gives:

$$r = h_{RL} \sin(\alpha_D + \alpha_{RL}) \tag{4}$$

Substituting equation (3) into equation (4) gives:

$$r = h_{RL} \sin\left(\tan^{-1} \frac{\Delta x}{y_{LD}} + \alpha_{RL}\right) \tag{5}$$

Substituting for Δx gives:

$$r = h_{RL} \sin\left(\tan^{-1} \frac{(x_L - x_D)}{y_{LD}} + \alpha_{RL}\right) \tag{6}$$

The values of $h_{RL}$, $y_{LD}$, $\alpha_{RL}$, $x_L$, are all known as these relate to fixed features of the tape drive. Therefore, once B is determined, $x_D$, and then r, can be determined. It will be appreciated that any suitable equations may be used to determine diameter data indicative of a diameter of the spool.

The above description has described determining the diameter of the supply spool 3 when the supply spool 3 is at a first angular position. In an implementation, the method of determining the diameter as described above is carried out at multiple angular positions of the spool 3. For example, once the diameter of the spool has been calculated at the first angular position, the diameter may be recalculated using the above method when the supply spool 3 has travelled through a predetermined angular rotation to a second angular position. For example, a predetermined angular rotation may be 45 degrees. By determining the diameter at different angular rotations, such as at 0 degrees, 45 degrees, 90 degrees, 135 degrees, 180 degrees, 225 degrees, 270 degrees, and 315 degrees, data indicative of the eccentricity of the spool 3 can be determined. Determination of eccentricity can be used, for example, to help control advancing of the ribbon during printing.

While the above method describes determining the diameter of the supply spool 3, it will be appreciated that the same method may be used to determine the diameter of the take-up spool 4. Determining the diameter and eccentricity data of the take-up spool 5 can help improve ribbon tracking, since eccentricity of the take up spool can be more pronounced in cases where a user takes a snapped ribbon and wraps the snapped ribbon back onto the take up spool by hand. Such re-tying of the ribbon can cause folds and uneven surface features on the take up spool 5 leading to the ribbon unwinding in an eccentric manner.

The emitters 36 may be used to detect dirt or any other obstruction on the detector 35. For example, all of the emitters 36 may be energised in turn and the determination of a boundary for each of the emitters 36 may be determined as described above. If all of the emitters 36 that are energised create a boundary at around the same location on the detection surface 35*a* of the detector 35, it can be determined that there is dirt on the detection surface 35*a*. This is because boundaries formed by the shadow cast by a spool will be in different positions on the detector 35 dependent on the position of the energised emitter 36. The detection of dirt may be determined using the method described above, where emitters 36 are energised multiple times, the background removed, and each filtered radiation signal combined. The detection of dirt may be carried out at any time, i.e. prior to, during, or after printing. An alert signal may be generated if dirt is detected so as to warn a user that dirt is present.

It will be appreciated that, in an embodiment, the tape drive may comprise multiple detectors. For example, multiple detectors may be used with a single emitter (or multiple emitters). The multiple detectors may be arranged in an array in a similar manner to the emitters shown in FIG. 4. As the spool 3 diameter changes, the shadow cast by an emitter 36 will block radiation from reaching some of the detectors of the array, but will not prevent radiation hitting others of the detectors of the array.

While various embodiments of the invention have been described above, it will be appreciated that various modifications can be made to the described embodiments without departing from the spirit and scope of the present invention.

The described and illustrated embodiments are to be considered as illustrative and not restrictive in character, it being understood that only the preferred embodiments have been shown and described and that all changes and modifications that come within the scope of the inventions as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A tape drive comprising:

first and second spool supports on which spools of tape may be mounted, an optical sensing system comprising a radiation emitter and a radiation detector, said radiation emitter and radiation detector having a fixed positional relationship in use with respect to said two tape spool supports;

a controller operative to:

energise the radiation emitter to emit radiation; and determine a diameter data indicative of a diameter of a spool mounted on one of the first and second spool supports based on a radiation signal generated by the detector, the radiation signal being indicative of a direct radiation path between the emitter and the detector, the radiation path being defined by the spool, wherein the controller is further operative to determine the diameter data when the tape spool is at a plurality of angular positions so as to obtain diameter data for each of the angular positions and to determine an average value of the diameter data for each of the angular positions.

2. A tape drive as in claim 1, wherein the controller is further operative to determine the diameter data based on predetermined positional data relating to the optical sensing system.

3. A tape drive as in claim 1, wherein the controller is further operative to determine the diameter data based on predetermined positional data relating to one of the first or second spool supports.

4. A tape drive as in claim 1, wherein the optical sensing system further comprises a plurality of radiation emitters, and wherein the controller is further operative to:

energise the plurality of radiation emitters to each emit radiation;

determine a diameter data indicative of a diameter of a spool mounted on one of the first and second spool supports based on a plurality of radiation signals generated by the detector, the plurality of radiation signals being indicative of two or more direct radiation paths between the emitters and the detector, the radiation paths being defined by the spool.

5. A tape drive as in claim 4, wherein the controller is further operative to:

determine a feature of the plurality of radiation signals; and determine, for each one of the plurality of radiation signals, diameter data indicative of the diameter of the spool based on the respective feature of the plurality of radiation signals.

6. A tape drive as in claim 5, wherein the feature is positional data relating to the plurality of radiation signals.

7. A tape drive as in claim 6, wherein the positional data comprises data relating to a boundary, the boundary separating a first region of the detector from a second region of the detector, where the first region corresponds to a region which receives a first level of radiation from an emitter and the second region corresponds to a region which receives a second level of radiation from the emitter.

8. A tape drive as in claim 5, wherein the controller is further operative to determine an average value of the diameter data, the average value being based on each of the diameter data generated using each one of the plurality of radiation signals.

9. A tape drive as in claim 8, wherein the controller is further operative to apply a weighting factor to each of the diameter data generated using each one of the plurality of radiation signals.

10. A tape drive as claim 9, wherein the weighting factor applied to each of the diameter data is dependent on the feature of the respective radiation signal.

11. A tape drive as in claim 5, wherein the controller is further operative to:

energise one or more of the plurality of the radiation emitters such that each one of the one or more of the plurality of the radiation emitters emits radiation a plurality of times; and use the plurality of radiation signals generated by the detector for a given emitter to determine the feature of the radiation signal.

12. A tape drive as in claim 11, wherein the controller is further operative to:

subtract a background noise signal from each of the plurality of radiation signals generated by the detector for a given emitter to obtain a plurality of filtered signals for the given emitter, and determine the feature of the radiation signal using the plurality of filtered radiation signals for the given emitter.

13. A tape drive as in claim 12, wherein the controller is further operative to:

determine a plurality of background noise signals, each one of the background noise signals being determined prior to, or after, detection of each one of the plurality of radiation signals for the given emitter; and subtract each respective one of the background noise signals from each respective one of the plurality of radiation signal for the given emitter.

14. A tape drive as in claim 1, further comprising a motor with a motor shaft on which the spools of tape are mounted and an encoder associated with the motor shaft, wherein the encoder is configured to provide an output indicative of each of the plurality of angular positions.

15. A tape drive as in claim 1, wherein the controller is further operative to determine an eccentricity of the tape spool using the diameter data for each of the angular positions.

16. A method of using a tape drive as claimed in claim 1 to determine a diameter data item indicative of a diameter of a tape spool.

17. A thermal transfer printer comprising:

a tape drive according to claim 1 arranged to transfer ink carrying tape between said first and second spools; and a printhead arranged to transfer ink from said ink carrying tape to a substrate.

18. A tape drive as in claim 1, wherein the optical sensing system is configured such that the direct radiation path between the emitter and the detector is defined by a direct line of sight between the emitter and the detector.

19. A tape drive as in claim 1, wherein the optical sensing system is configured such that the direct radiation path between the emitter and the detector excludes intermediary surfaces that reflect the radiation signal.

20. A tape drive as in claim 1, the controller further operative to control, based on the determined average value of the diameter data, advancement of the tape.

21. A tape drive comprising:

first and second spool supports on which spools of tape may be mounted, an optical sensing system comprising a plurality of radiation emitters and a radiation detector, said radiation emitters and radiation detector having a fixed positional relationship in use with respect to said two tape spool supports;

a controller operative to:

energize the radiation emitters to emit radiation; and determine a diameter data indicative of a diameter of a spool mounted on one of the first and second spool supports based on a radiation signal generated by the detector, the radiation signal being indicative of a direct radiation path between the emitter and the detector, the radiation path being defined by the spool;

the controller further operative to:

energize two or more of the radiation emitters in turn to emit a first radiation and a second radiation;

determine a first feature of a first radiation signal generated by the detector, the first radiation signal associated with the first radiation;

determine a second feature of a second radiation signal generated by the detector, the second radiation signal associated with the second radiation;

compare the first feature with the second feature; and determine, based on the comparison, the presence of dirt on the detector.

* * * * *